United States Patent [19]

Marquart et al.

[11] 3,943,952

[45] Mar. 16, 1976

[54] TENT

[75] Inventors: Tom Eugene Marquart, Leslie; Robert Roger Cantwell, New Haven, both of Mo.

[73] Assignee: Kellwood Company, St. Louis, Mo.

[22] Filed: Feb. 19, 1975

[21] Appl. No.: 551,060

[52] U.S. Cl. ..... 135/1 R; 135/3 E; 135/14 V

[51] Int. Cl.[2] ..... A45F 1/00; A45F 1/10

[58] Field of Search ..... 135/1 R, 3 E, 14 V

[56] References Cited

UNITED STATES PATENTS

| | | | |
|---|---|---|---|
| 3,043,320 | 7/1962 | Moss | 135/1 R |
| 3,058,480 | 10/1962 | Blauchard | 135/3 E |
| 3,356,098 | 12/1967 | Krutzikowsky | 135/14 V |
| 3,621,857 | 11/1971 | May et al. | 135/1 R |
| 3,699,986 | 10/1972 | Kirkham | 135/1 R |

FOREIGN PATENTS OR APPLICATIONS

| | | | |
|---|---|---|---|
| 1,121,674 | 5/1956 | France | 135/1 R |

*Primary Examiner*—Werner H. Schroeder
*Assistant Examiner*—Conrad L. Berman
*Attorney, Agent, or Firm*—Koenig, Senniger, Powers and Leavitt

[57] ABSTRACT

A tent comprising a bay extending from front to rear and wings extending laterally outwardly from opposite sides thereof, each wing having a front wall and a back wall, each wall of each wing comprising an outside screen and an inside closure flap adapted to be closed on the inside of the screen or opened for ventilation purposes, the closure flaps also being adapted to form partitions dividing the bay into individual chambers.

7 Claims, 10 Drawing Figures

TENT

BACKGROUND OF THE INVENTION

This invention relates to tents, and more particularly to a tent with a ventilation feature.

SUMMARY OF THE INVENTION

Among the several objects of this invention may be noted the provision of an improved tent having means allowing for ventilation of the tent from a number of directions; the provision of such a tent having sufficient headroom for at least four adults; and the provision of such a tent having screens to provide for ventilation, with closure flaps for the screens, the closure flaps also serving as means for dividing the tent into a number of individual rooms or chambers to enable occupants to have privacy.

In general, a tent of this invention has two opposite side walls and a pair of wings, one extending laterally outwardly from one side wall and the other extending laterally outwardly from the other side wall. Each side wall comprises a front section and rear section with a wing opening therebetween. Each wing comprises a front wall joined to the rear edge of the front section of the respective side wall and a back wall joined to the front edge of the rear section of the respective side wall. Each front wing wall comprises an outside screen and an inside closure flap joined to the respective front side wall section at said rear edge thereof. Each back wing wall comprises an outside screen and an inside closure flap joined to the respective rear side wall section at said front edge thereof. Each closure flap is adapted to be closed on the inside of the respective screen or opened for ventilation, the closure flaps of the front wing walls are adapted to be placed in a position extending transversely of the tent and inwardly from the rear edges of the front side wall sections to form a partition closing off a chamber in the tent between the front side wall sections, and the closure flaps of the back wing walls are adapted to be placed in a position extending transversely of the tent and inwardly from the front edges of the back side wall sections to form a partition closing off a chamber in the tent between the back side wall sections.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
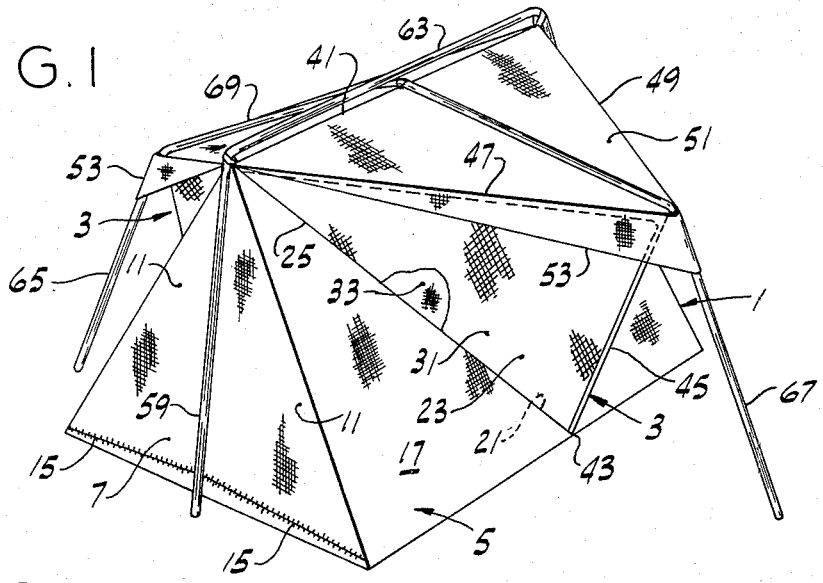
FIG. 1 is a perspective of a two-wing tent of this invention as it appears when erected.

Referring to the drawings, first more particularly to FIGS. 1–4, a tent of this invention is shown generally to comprise a main section or bay 1 extending from front to rear and a pair of wings each designated in its entirety by the reference numeral 3. The main section or bay 1 comprises two opposite side walls each designated 5. One wing 3 extends laterally outwardly from one of the side walls 5 and the other wing 3 extends laterally outwardly from the other side wall 5. The front end of the bay is designated 7 and the rear end of the bay is designated 9, the front end being provided with suitable door flaps such as indicated at 11 which may be provided with slide fasteners as indicated at 13 and 15. The rear end may also be provided with such door flaps, if so desired. In such case, either end may be regarded as the front and the other as the rear. For purposes of this description, however, the end 7 will be denoted as the front and the end 9 as the rear.

Each side wall 5 comprises a front section or panel 17 and a rear section or panel 19 with a wing opening 21 between these sections, the opening 21 in each wall providing for lateral communication and access between the bay 1 and the respective wing 3. Each wing comprises a front wall 23 joined to the rear edge 25 of the front section 17 of the respective side wall (at the front of the wing opening 21) and a rear wall 27 joined to the front edge 29 of the rear section 19 of the respective side wall (at the rear of the wing opening). Each front wing wall 23 comprises an outside screen 31, e.g., a panel of nylon netting such as conventionally used for screens in tents, and an inside closure flap 33, e.g., a flap of rain-resistant canvas or other suitable tent fabric, joined to the respective front side wall section 17 at the rear edge 25 thereof. Each back wing wall 27 similarly comprises an outside screen 35 and an inside closure flap 37 joined to the respective rear side wall section 19 at the front edge 29 thereof. Each of the closure flaps 33 and 37 is adapted to be closed on the inside of its respective screen 31 or 35 to serve as a barrier for the screen, or opened (as will appear) for ventilation purposes. Also, the closure flaps 33 of the front wing walls 23 are adapted to be placed in a position extending transversely of the tent and inwardly from the rear edges 25 of the front side wall sections 17 to form a partition closing off a room or chamber in the tent between the front side wall sections, and the closure flaps 37 of the back wing walls 27 are adapted to be placed in a position extending transversely of the tent and inwardly from the front edges 29 of the back side wall sections 19 to form a partition closing off a room or chamber in the tent between the back side wall sections.

Figure 2:
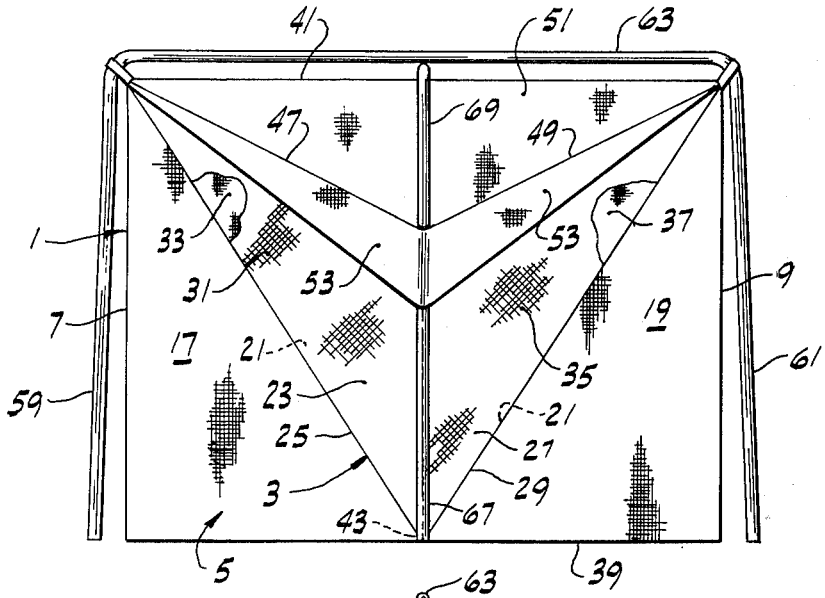
FIG. 2 is a side elevation of the erected tent, with parts broken away.
Figure 3:
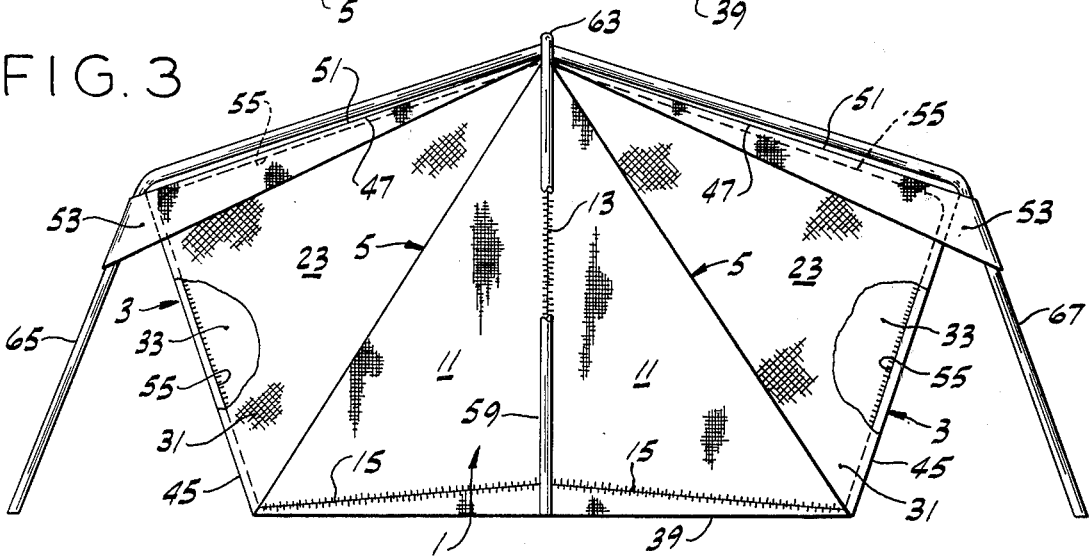
FIG. 3 is a front elevation of the erected tent, with parts broken away.
Figure 4:
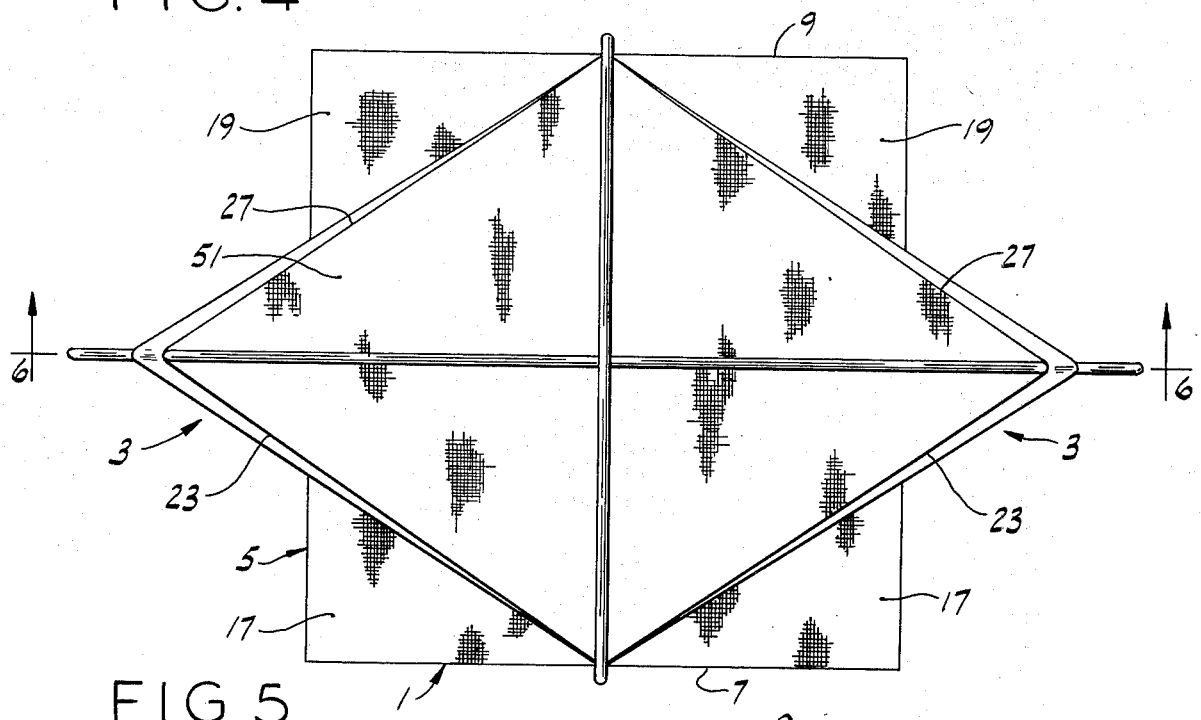
FIG. 4 is a plan of the erected tent.

More particularly, the main section or bay 1 comprises a rectangular floor panel 39. The side walls 5 of the bay are inclined toward one another in upward direction from the side margins of the floor 39, meeting at a ridge 41 which extends from front to rear of the bay at a suitable elevation to provide headroom for persons standing in the tent. Thus, the bay 1, at any vertical transverse section, is of isosceles triangular form, the base of the triangle being the width of the floor 39, the apex of the triangle being at the ridge 41. The wing opening 21 in each of the inclined side walls 5 is in the shape of an isosceles triangle which, as appears best in FIG. 2, is inverted, with its base at the ridge 41 and its apex 43 adjacent the lower edge of the respective side wall 5. As herein illustrated, the base dimension of the isosceles triangular wing opening 21 (at the ridge 41) is about equal to the width of the bay 1 at the floor 39. The sides of the isosceles triangular wing opening 21 are the edges 25 and 29 (see FIG. 2).

Each front wing wall 23 is in the shape of a triangle, having one leg coincident with the rear edge 25 of the respective front side wall section 17, a second leg 45 extending upwardly and inclined outwardly from the bottom apex 43 of the respective wing opening 21, and a third leg 47 extending between the upper end of edge 25 at the ridge 41 and the upper end of the second leg 45. Similarly, each back wing wall 27 is in the shape of a triangle, having one leg coincident with the front edge 29 of the respective rear side wall section 19, a second leg 45 coincident with leg 45 of the respective front wing wall 23, and a third leg 49 extending between the upper end of edge 29 at the ridge 41 and the upper end of leg 45. In addition to the front and back wing walls 23 and 27, each wing 3 additionally comprises a roof panel 51 of generally triangular form extending laterally outwardly from the ridge 41 at the top of the side walls 5 of the bay. This triangular roof panel 51 has its base at the ridge 41 at the top of the wing opening 21 and its side margins joined to the upper edges 47 and 49 of the front and back wing walls 23 and 27. The roof panel 51 is preferably formed with eaves such as indicated at 53 overhanging the wing walls 23 and 27, for protecting the wing walls from the elements. Thus, each roof panel 51 serves as a hood for the respective wing 3.

As to each of the two front wing walls 23, both the outside screen 31 and the inside closure flap 33 are joined (as by stitching) at their inner edge at 25 to the respective front side wall sections 17 and the closure flap 33 is detachably secured to the screen 31 along its other two edges adjacent 45 and 47 as by a slide fastener 55. Similarly, as to each of the two rear wing walls 27, both the outside screen 35 and the inside closure flap 37 are joined (as by stitching) at their inner edge at 29 to the respective rear side wall section 19 and the closure flap 37 is detachably secured to the screen along its other two edges adjacent 45 and 49 as by a slide fastener 57.

A frame for supporting the tent is shown to comprise an external longitudinal support for the main section or bay 1 comprising front and rear legs 59 and 61 and a ridge pole 63 extending between these legs above the ridge 41 of the tent and supporting the ridge, and an external transverse support for the wings 3 comprising left and right side legs 65 and 67 and a wing roof pole 69 extending over the tops 51 of the wings, with the upper ends of the legs extending through holes at the intersection of edges 47 and 49 and with the eaves draped on the outside of the upper ends of the legs.

Figure 9:
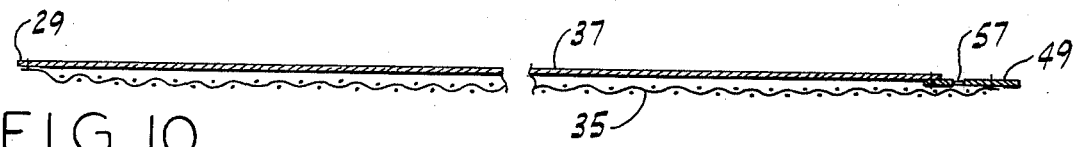
FIG. 9 is an enlarged section on line 9—9 of FIG.. 6.
Figure 6:
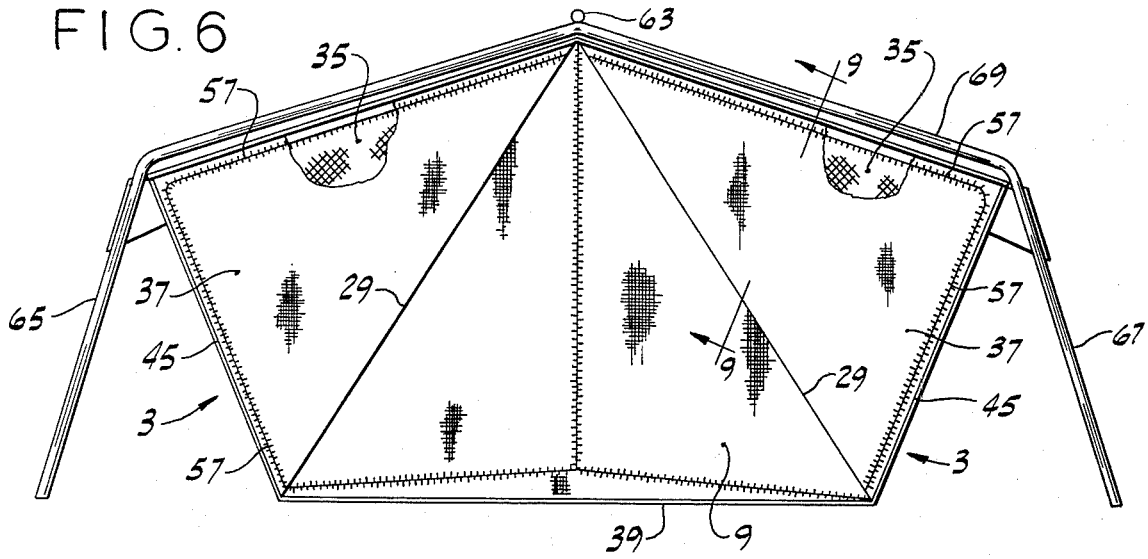
FIG. 6 is a vertical transverse section on line 6—6 of FIGS. 2 and 4 showing the closure flaps for the back walls of the two wings in a closed position covering the inside of screen material of the back wing walls, said closure flaps being broken away in part.

The closure flaps 33 of the front wing walls 23 are adapted to be disposed in closed position on the inside of the front wing wall screens 31 and held therein by means of the slide fasteners 55 (see FIGS. 1–3), and the closure flaps 37 of the rear wing walls 27 are adapted to be disposed in closed position on the inside of the rear wing wall screens 35 and held therein by means of the slide fasteners 57 (see FIGS. 2, 6 and 9). This completely closes the tent.

Figure 5:
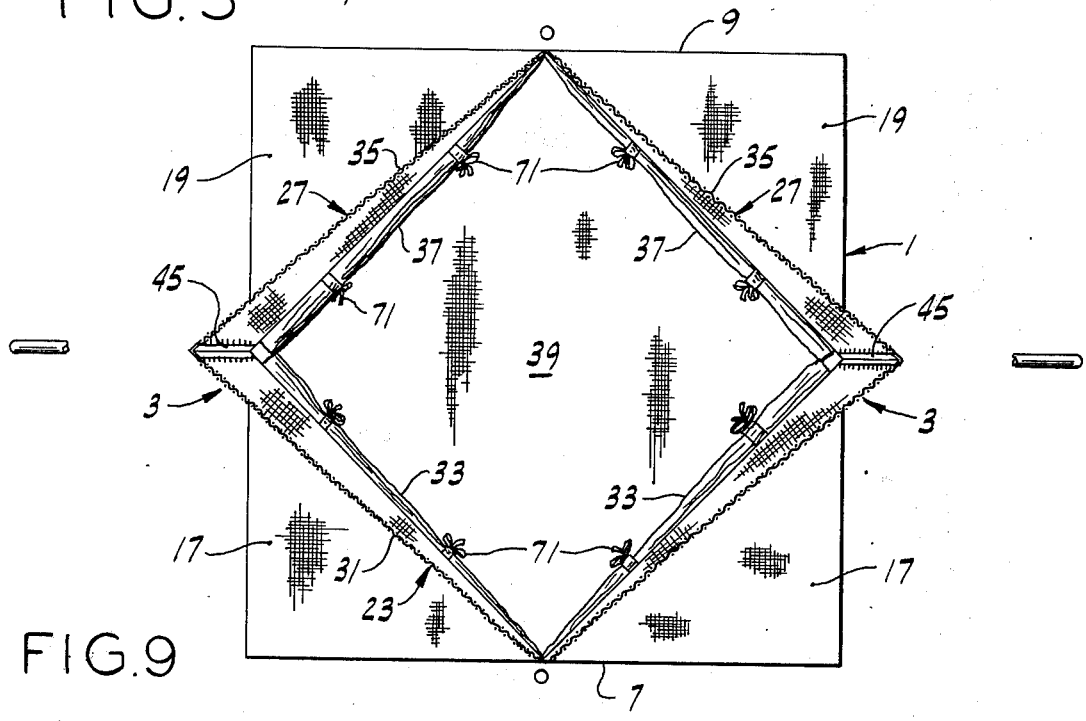
FIG. 5 is a view corresponding to FIG. 4 with the roof panels of the two wings of the tent removed, and showing closure flaps of the front and back walls of the wings furled for ventilation via wing wall screens.
Figure 10:
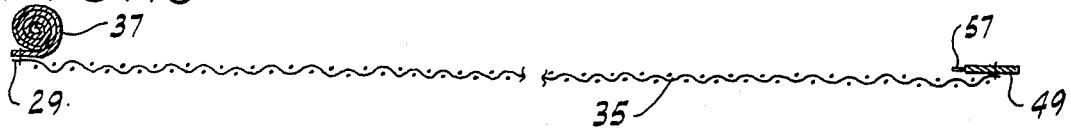
FIG. 10 is an enlarged section on line 10—10 of FIG. 7.
Figure 7:
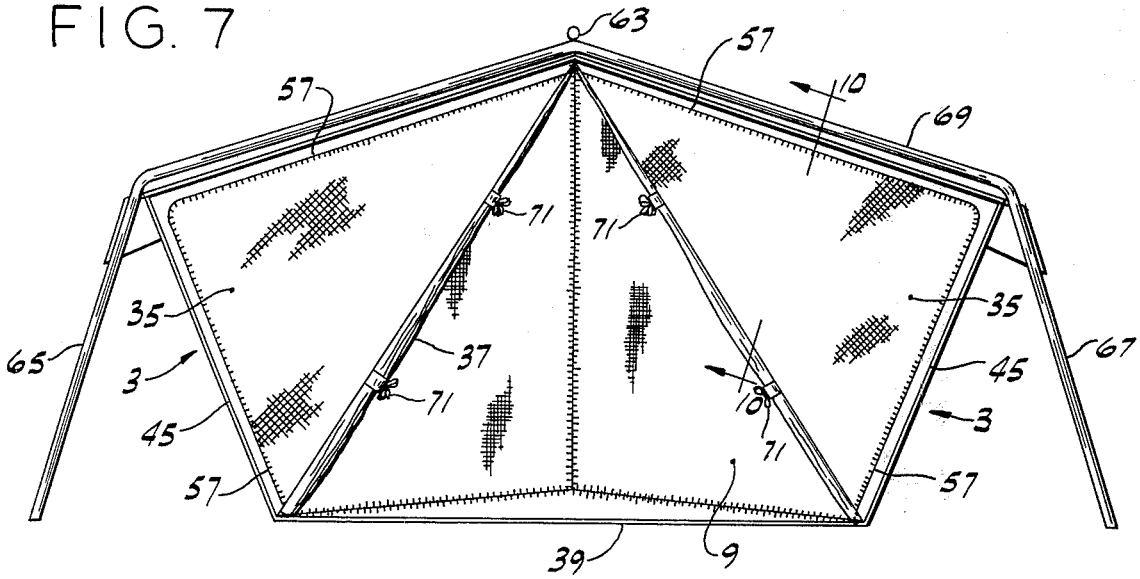
FIG. 7 is a view similar to FIG. 6 showing the closure flaps furled to open the screen material for ventilation.

For ventilation purposes, the closure flaps 33 of the front wing walls 23 may be unzipped and furled by rolling them up as shown in FIG. 5, and the closure flaps 37 of the rear wing walls 27 may be unzipped and furled by rolling them up as shown in FIGS. 5, 7 and 10. Suitable means such as ties 71 (FIG. 5) may be provided for maintaining the flaps furled. The flaps 33 are rolled up to the edges 25, thus fully opening the front wing wall screens 31, and the flaps 37 are rolled up to the edges 29, thus fully opening the rear wing wall screens 35. These screens are located on the four sides of a parallelogram as appears in FIG. 5 and thus provide for ventilation from four directions.

Figure 8:
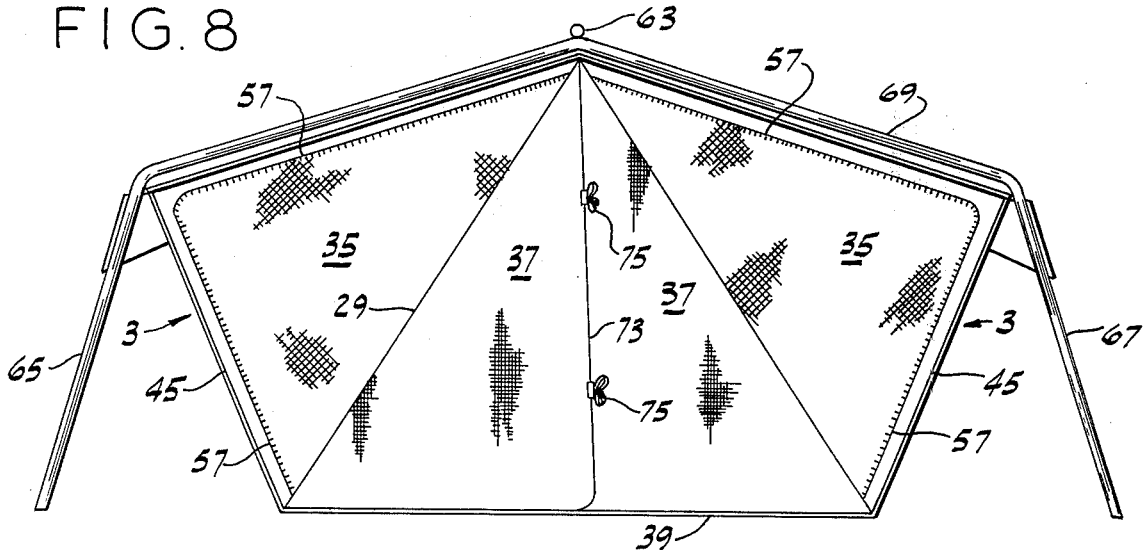
FIG. 8 is a view similar to FIG. 7 showing the closure flaps unfurled and positioned to form a partition closing off a chamber in the tent between the back side wall sections of the tent.

The closure flaps 33 of the front wing walls 23 are adapted to be placed in a position extending transversely of the main section or bay 1 of the tent, and inwardly from the rear edges 25 of the front side wall sections 17 of the main section 1, to form a partition closing off a chamber in the tent between the front side wall sections. Similarly, the closure flaps 37 of the rear wing walls 27 are adapted to be placed in a position extending transversely of the main section 1 of the tent, and inwardly from the front edges 29 of the back side wall sections 19 of the main section 1, to form a partition closing off a chamber in the tent between the back side wall sections. FIG. 8 illustrates this for the flaps 37 of the rear wing walls, showing how these flaps are swung in on the lines 29, and lap one another at 73 to some extent at the center of the main section 1. Suitable means such as ties 75 may be provided for maintaining the flaps in their partitioning position. With both sets of flaps 33 and 37 in their partitioning position, the tent is divided into three chambers, a front, an intermediate and a rear chamber, the front being between the front side sections 17, the intermediate including the wings 3, and the rear being between the rear side sections 19.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tent having two opposite side walls and a pair of wings, one extending laterally outwardly from one side wall and the other extending laterally outwardly from the other side wall, each side wall comprising a front section and a rear section with a wing opening therebetween, each wing comprising a front wall joined to the rear edge of the front section of the respective side wall and a back wall joined to the front edge of the rear section of the respective side wall, each front wing wall comprising an outside screen and an inside closure flap joined to the respective front side wall section at said rear edge thereof, each back wing wall comprising an outside screen and an inside closure flap joined to the respective rear side wall section at said front edge thereof, each closure flap being adapted to be closed on the inside of the respective screen or opened for ventilation, the closure flaps of the front wing walls being adapted to be placed in a position extending transversely of the tent and inwardly from the rear edges of the front side wall sections to form a partition closing off a chamber in the tent between the front side wall sections, the closure flaps of the back wing walls being adapted to be placed in a position extending transversely of the tent and inwardly from the front edges of the back side wall sections to form a partition closing off a chamber in the tent between the back side wall sections.

2. A tent as set forth in claim 1 having means for releasably securing the closure flap of each of the front wing walls to the respective screen at its edges away from the rear edge of the respective front side wall section, and means for releasably securing the closure flap of each of the rear wing walls to the respective screen at its edges away from the front edge of the respective rear side wall section, said flaps being adapted to be opened by releasing them from the screens at the edges where they are releasably secured and rolling them up.

3. A tent as set forth in claim 1 wherein each wing further comprises a roof panel extending laterally outwardly from the top of the side walls.

4. A tent as set forth in claim 1 wherein the roof panel has eaves overhanging the wing walls.

5. A tent as set forth in claim 1 of triangular form in transverse cross section with the side walls inclined toward one another and meeting at a ridge, each wing opening being in the shape of an inverted triangle with its base at the ridge and its apex adjacent the lower edge of the respective side wall.

6. A tent as set forth in claim 5 wherein each front wing wall is in the shape of a triangle having one leg coincident with the rear edge of the respective front side wall section, and a second leg extending upwardly from said apex of the respective wing opening, and a third leg extending between the ridge and the upper end of the second leg, each wing having a triangular roof panel.

7. A tent as set forth in claim 6 having slide fastener means for releasably securing each closure flap to the respective screen along the respective second and third legs.

* * * * *